US005526441A

United States Patent [19]

Codnia et al.

[11] Patent Number: 5,526,441

[45] Date of Patent: Jun. 11, 1996

[54] FULL RANGE CONVEX ELECTRODYNAMIC LOUDSPEAKER

[76] Inventors: Basilio Codnia; Juan P. Codnia, both of 2103 Cobblestone La. #M, New Orleans, La. 70114

[21] Appl. No.: 292,257

[22] Filed: Aug. 18, 1994

Related U.S. Application Data

[63] Continuation of Ser. No. 792,647, Nov. 15, 1991, abandoned.

[51] Int. Cl.[6] ..... H04R 25/00

[52] U.S. Cl. ..... 381/202; 381/192; 381/194

[58] Field of Search ..... 381/202, 204, 381/194, 195, 192, 197, 199; 181/157, 173, 174

[56] References Cited

U.S. PATENT DOCUMENTS

| | | | |
|---|---|---|---|
| 3,456,755 | 7/1969 | Walker | 181/31 |
| 3,720,787 | 3/1973 | Ishii et al. | 381/90 |
| 3,925,626 | 12/1975 | Stallings, Jr. | 381/202 |
| 4,472,605 | 9/1984 | Klein | 179/115.5 |
| 4,584,439 | 4/1986 | Paddock | 381/202 |
| 4,665,550 | 5/1987 | Haas | 381/182 |
| 4,817,165 | 3/1989 | Amalaha | 381/202 |
| 4,881,265 | 11/1989 | Gala | 381/90 |
| 5,009,281 | 4/1991 | Yokoyama | 381/159 |

FOREIGN PATENT DOCUMENTS

| | | | |
|---|---|---|---|
| 0886487 | 9/1953 | Germany | 381/202 |
| 3241898 | 7/1984 | Germany | 381/202 |

*Primary Examiner*—Curtis Kuntz
*Assistant Examiner*—Huyen D. Le
*Attorney, Agent, or Firm*—J. Pablo Codnia

[57] ABSTRACT

A convex electrodynamic loudspeaker having hemispherical sound emission characteristics and full range frequency response. It comprises a conical convex diaphragm and a voice coil form having a voice coil wound around its cylindrical end while its opposite conical end protrudes the central dome-shaped part of the convex diaphragm where both parts are cemented together. The voice coil form operates as a reciprocate motion member to the convex diaphragm efficiently even in the highest audio frequencies. The configuration of the convex diaphragm provides hemispherical characteristics of sound emission for overall the audio frequencies.

7 Claims, 3 Drawing Sheets

FULL RANGE CONVEX ELECTRODYNAMIC LOUDSPEAKER

This is a continuation of Ser. No. 07/792,647, filed Nov. 15, 1991, now abandoned.

BACKGROUND OF THE INVENTION

1. Field of the Invention

This invention relates to an electrodynamic loudspeaker suitable for use in low, medium and high range audio frequencies having substantially hemispherical sound emission characteristics.

2. Description of the Prior Art

In recent years, audio systems have reached a remarkable level of evolution. However loudspeakers, the last step in the process of converting electrical signals to sound, have not had notorious changes although worldwide manufacturers are encouraged to develop significant improvements to satisfy the most demanding market. For instance, one particular concern is to design a full range loudspeaker with wide dispersion of sound.

Presently, it is standard to use a woofer for low frequency signals; A mid range for medium frequency signals in which the human voice is ranged and the hearing sense analyzes sound waves by comparison of phases in each ear and by the intensity of the signals, thus producing the stereophonic effect; And finally a tweeter for high frequency signals. But for high frequencies, traveling sound waves are very directional, reason why tweeters utilize sound dispersion devices that include sound deflectors.

For medium range audio frequencies it is not possible to build a system that utilizes sound deflectors to broaden the sound dispersion without causing undesired interference effects on acoustic waves of certain frequencies, and it is precisely the wider or narrower sound dispersion what determines the most adequate area for stereophonic listening.

In order to provide background information so that the invention may be completely understood and appreciated in its proper context, reference is made to a number of prior art patents and publications as follows:

An advertisement on page 23 of Radio Electronics, November 1990, presents a new technique by restoration of certain frequencies in recorded audio to obtain a new kind of sound that would replace the effect of multiple speaker arrays.

Such new kind of sound is due to improvements in the amplifier circuitry being not related to speaker systems, limited to certain applications.

U.S. Pat. No. 4,881,265 discloses a system combining two tweeters and two woofers mounted in apex cabinet at an angle of 70°, duplicating the angle of dispersion of a single tweeter.

According to the assembly, however, the angle of dispersion increases only in the horizontal plane while the vertical plane remains unaffected.

U.S. Pat. No. 3,720,787 discloses a globular speaker system with omnidirectional characteristics constituted by a plurality of speakers attached to a spherical baffle.

The main disadvantage of this device is its structural complexity, and to overcome acoustic interference effects in certain frequencies.

U.S. Pat. No. 3,456,755 discloses two hydraulic loudspeakers arranged in a sphere for omnidirectional dispersion of sound, and it is said that this device operates on the principle that a liquid under pressure exert equal force in all directions so that a diaphragm subjected to the fluctuations of pressure incidental to the movement of a voice coil carrying a signal will respond in a uniform manner over its entire surface.

The coupling between voice coil and diaphragm is not by rigid means, since vibrations are transmitted through liquid. Matching the acoustic impedances between the liquid means and the air for all audio frequencies is very difficult.

U.S. Pat. No. 4,472,605 discloses two hemispherical diaphragms each one arranged on either side of a disc-shaped carrier forming a sphere to radiate sound in all directions.

It is designed for low and mid range frequencies only. Even for low frequencies its limitation lies in the undesired effects caused by the small amount of air volume between diaphragms in the interior of the loudspeaker and also in the fact that toward the edge of the hemispherical diaphragm vibrations radiated become weaker as the lines tangent to that part of the hemispherical diaphragm and the voice coil carrier axis tend to parallels.

U.S. Pat. No. 4,665,550 discloses an electrodynamic loudspeaker having omnidirectional sound emission in high or medium frequency. Therefore, it cannot be a full range loudspeaker.

Whatever the advantages and features of the above cited references, none of them fulfills the objects of the present invention.

SUMMARY OF THE INVENTION

The present invention is intended to provide an improved electrodynamic loudspeaker of simple constitution, having hemispherical sound emission characteeristics and full range audio frequency response, previously achieved by known multiple speaker arrays and special enclosures.

According to our invention, the full range convex loudspeaker comprises a convex diaphragm that can be made of the same materials used in diaphragms of known loudspeakers, of substantial flexibility in its outer portion and becoming increasingly stiffer around the vertex dome-shaped part which has a central hole that is protruded by the conical end of a novel voice coil form where both parts are cemented. The opposite end of the voice coil form is cylindrical and a voice coil is wound around it. The voice coil form, by action of signal currents through the voice coil, operates as a reciprocate motion member to the convex diaphragm. A permanent magnet assembly provides radial magnetic field in an annular space, air gap, where the voice coil is arranged and centered by a resilient spider bonded peripherally to the permanent magnet assembly which is properly mounted on a frame of circular rim to where the diaphragm is fastened. The convex diaphragm, according to the invention, features more effective sound emission surface then responding even to lower frequencies than hemispherical diaphragms of the same area, and its relatively lighter weight combined with the stiffer dome-shaped part protruded by the conical end of the novel voice coil form enables the convex diaphragm to vibrate to more extended high frequency range than the compared hemispherical diaphragms with the same diameter utilized in prior art wide dispersion electrodynamic loudspeakers. Furthermore, the fact that the diaphragm has convex configuration broadens the angle of sound dispersion resulting approximately hemispherical for overall the frequency range of sound emission.

The voice coil form of the present invention is made of adequate materials, with enough stiffness but small thickness to be of light weight. Its constituting parts, the conical and the cylindrical, may be fabricated separately and ultimately cemented together.

In a preferred embodiment of the present invention both parts the conical and the cylindrical of this voice coil form may be fabricated in one piece.

In another embodiment of this novel voice coil form its constituting parts: the cylindrical, the conical and the diaphragm dome-shaped part are integrated in a single molded element.

In another preferred embodiment it is noticeable that the permanent magnet assembly may be fixed to the frame by the inner side of said frame.

The above cited choices do not cause any alterations to the advantageous features of the present invention, being basically described for manufacturing purposes.

In a further preferred embodiment the conical shape of the convex diaphragm of our invention gradually decreases in angle from the rim toward its center top, which is still dome-shaped, forming a substantially sinus-shaped convex diaphragm.

In yet another embodiment the convex diaphragm is entirely conical and is superimposed onto the conical end of the voice coil form. The diaphragm has the same vertex angle than that of conical end of the voice coil form thus resulting in a congruent assembly.

Any of the loudspeakers of the present invention can be horizontally mounted on top of the enclosure with its apex facing up, by which sound dispersion will be of 360° around the loudspeaker. If it is mounted as is usual with conventional speaker systems, vertically in the front side of a baffle, the sound dispersion will be of approximately 180° around the loudspeaker which is enough to overcome the well known limitations due to sound emission directionality, especially from conventional mid-range loudspeakers, and its consequent "sweet spot", the specific area where the stereophonic effect is at its best.

In order to provide more illustrative information, suggested enclosures and principal features of the preferred layouts are included in the accompanying drawings and following description.

DETAILED DESCRIPTION OF THE PREFERRED EMBODIMENTS

Figure 1:
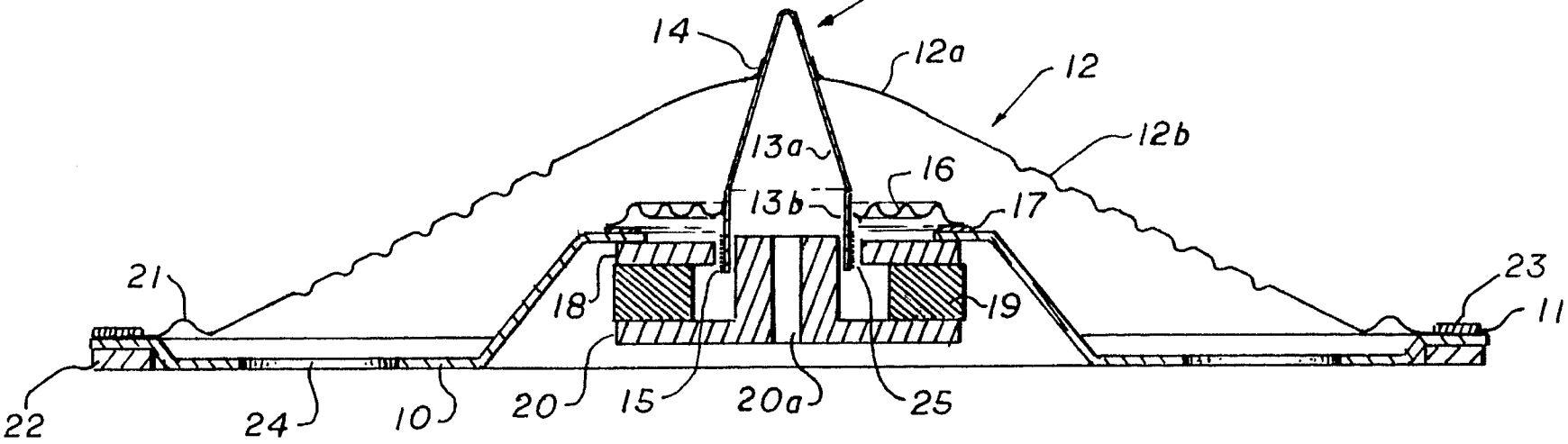
FIG. 1 is a vertical sectional view of the full-range convex loudspeaker in accordance with one embodiment of the present invention.

In accordance to FIG. 1 the preferred embodiment of the loudspeaker of the present invention comprises a permanent magnet assembly constituted by a flange 20 a permanent magnet 19 and a yoke plate 18 secured concentrically to the frame 10. The hole in the center of the yoke plate 18 has greater diameter than the cylindrical central part of the flange 20 and it determines a space between both pole pieces, air gap 25, in which a radial magnetic field is established as originated by the permanent magnet 19. In the air gap 25 the voice coil 15 is allocated and it is wound around the tubular cylindrical end **13*b* of the voice coil form 13 whose opposite end, conical end 13*a*, protrudes the convex diaphragm 12 through its central dome shaped part 12*a* all around the central hole 14 wherein both parts are cemented together thus forming a reciprocating motion member to transmit the vibrations produced in the voice coil 15 by action of the electrical audio signals applied thereto interacting with the permanent magnetic field in the air gap 25**.

In the voice coil form 13, the cylindrical end **13*b* and the conical end 13*a* can be made of the materials utilized in known bobbins, such as coated paper or plastics. Nevertheless, it is important to stress that in order to obtain the maximum efficiency, even in the highest audio frequencies, the best material should be of light weight and rigid consistency and is worth it to mention that the geometry of the voice coil form 13 featuring the conical end 13*a* of the present invention leads the above said characteristics. The conical end 13*a* in conjunction with the stiffer dome-shaped part 12*a* of the convex diaphragm 12** allows the emission of higher audio frequencies with substantially hemispherical characteristics of sound dispersion.

The voice coil 15 remains centered in the air gap 25 by means of a spider 16 which is made of resilient material and is fixed peripherally to the ring 17 permitting the voice coil form 13 to have free axial displacement. The frame 10 has several openings 24 which communicate the space inside the loudspeaker with the surrounding area. The loudspeaker assembly is completed by fixing the diaphragm 12 to the frame 10 by the corrugated rim 21 (suspension) using the mounting lip 11 and secured by a securing gasket 23. A paper gasket 22 helps fastening the loudspeaker to the enclosure tight. The flange 20 has a positioning bore **20*a*** through which a fitting non-magnetic positioning pin can be inserted during the assembly of the vibrating parts.

Figure 4:
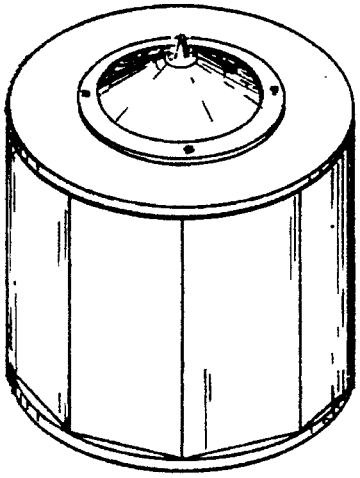
FIG. 4 shows a perspective view of an illustrative enclosure of the invention in horizontal mounting.
Figure 5:
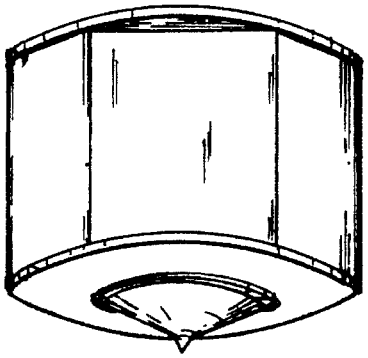
FIG. 5 shows a perspective view of another illustrative enclosure of the invention in ceiling mounting.
Figure 6:
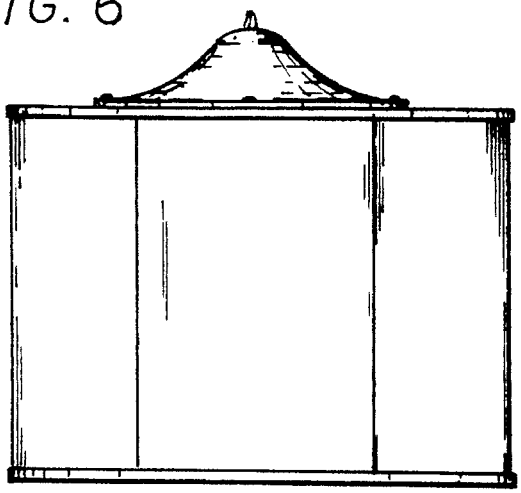
FIG. 6 shows an elevational view of the enclosure of FIG. 4 using the embodiment of the invention depicted in FIG. 3.

The convex configuration of the diaphragm 12 comprising the cone-shaped part **12*b* and the dome-shaped part 12*a* determines that for overall the range of audio frequencies emitted whether low medium or high, sound dispersion is achieved substantially at an arc of approximately 180° in front of the loudspeaker if mounted vertically (FIG. 7) and of 360° around its apex if mounted horizontally (FIGS. 4, 5 and 6**).

Figure 2:
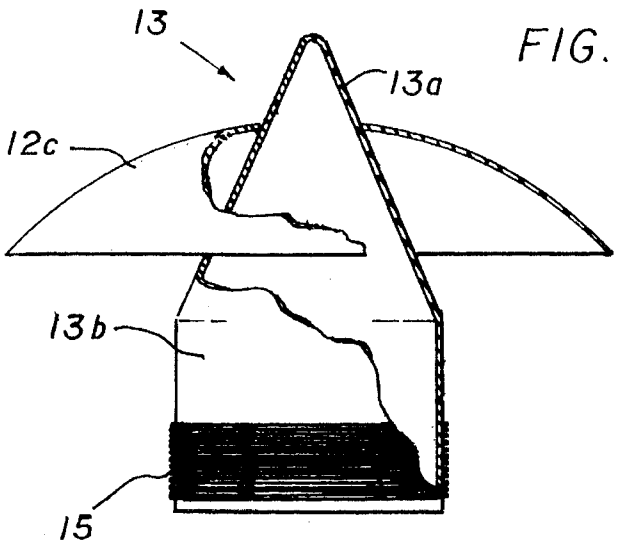
FIG. 2 shows an elevational partially sectional view of the novel voice coil form configuration.

FIG. 2 shows an elevational partly sectional view of the novel voice coil form 13 in which its constituting parts previously disclosed can be more illustratively appreciated.

According to the invention, the cylindrical end **13*b* its opposite conical end 13*a* and the dome-shaped part 12*c* are fabricated in one molded piece, preferably plastic, of sufficient rigidity and being as thin as conditioned by the material chosen to obtain a unit capable of handling higher audio frequencies while actuating as driver member to the convex diaphragm 12, without suffering deformations that may otherwise occur for instance in low frequency as the axial displacement resulting from the reciprocate motion to the convex diaphragm 12** is greater.

Figure 3:
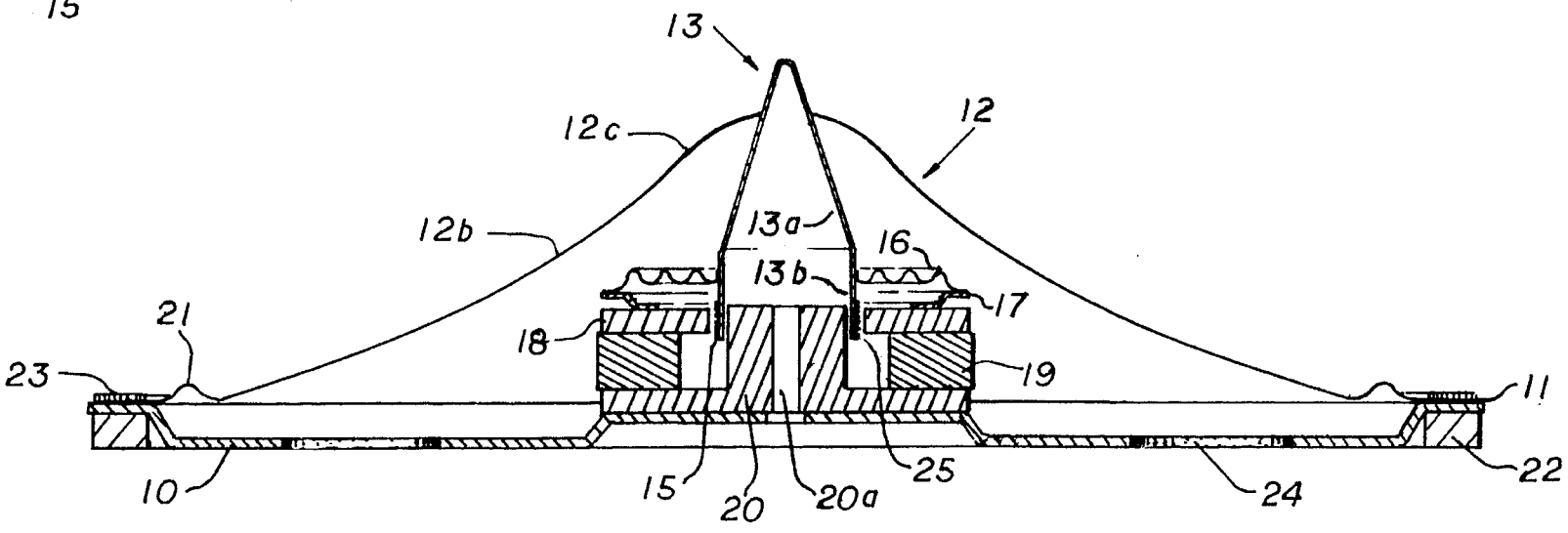
FIG. 3 is a vertical sectional view of the full-range sinus-shaped convex loudspeaker in accordance with another embodiment of the present invention.

FIG. 3 is a sectional view of another preferred embodiment of the loudspeaker according to the invention. In this embodiment the cone-shaped part 12*b* decreases in angle from the corrugated rim 21 toward the center where is joined to the dome-shaped part 12*c* of the novel voice coil form 13 (shown in FIG. 2) constituting a sinus-shaped electrodynamic loudspeaker, featuring substantially hemispherical characteristics of sound dispersion.

In a further embodiment of the present invention the convex diaphragm 12 is entirely conic from its edge to its vertex. The conical end 13*a*, having the same angle than the diaphragm 12, is bonded to the vertex of the diaphragm 12 resulting in a congruent mounting.

Any of the embodiments presented and described herein can be advantageously utilized in stereophonic systems. In this regard, the illustrations are intended to give a practical reference on how to choose the enclosure according to the ambient. For instance, FIGS. 4 and 6 show a convenient enclosure of the invention for the average living room.

FIG. 5 shows a logical choice if the enclosure of the invention was to be fitted in a small room or a place with reduced free space.

Figure 7:
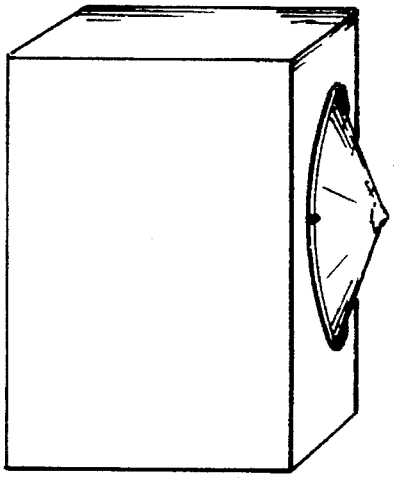
FIG. 7 shows a perspective view of an enclosure in vertical mounting of a further embodiment in accordance with the invention.

FIG. 7 shows an enclosure suitable for speaker systems to be placed nearby the wall.

Still, depending on the selected allocation and the structural specifications such as the loudspeaker dimensions, the application references cited above should not restrain the use of different types of enclosures in stadiums or other facilities where concerts or public events take place.

It is also suggested for the enclosures the use of a fashionable cover grille (not shown in the drawings).

The foregoing description of the preferred embodiments and enclosures has been presented for the purposes of illustration and modifications are possible in light of the above teaching. It is intended that the scope of the present invention be limited not by this detailed description but rather by the claims appended hereto.

REFERENCE NUMERALS

10. Frame
11. Mounting lip (Frame)
12. Convex diaphragm
12*a*. Dome-shaped part (Diaphragm)
12*b*. Cone-shaped part (Diaphragm)
12*c*. Dome-shaped part (Voice coil form)
13. Voice coil form
13*a*. Conical end (Voice coil form)
13*b*. Cylindrical end (Voice coil form)
14. Central hole
15. Voice coil
16. Spider
17. Ring
18. Yoke plate (Permanent magnet assembly)
19. Permanent magnet (Permanent magnet assembly)
20. Flange (Permanent magnet assembly)
20*a*. Positioning bore
21. Corrugated rim (Suspension)
22. Paper gasket
23. Securing gasket
24. Openings (Frame)
25. Air gap (Permanent magnet assembly)

We claim:

1. A convex diaphragm, to provide substantially hemispherical emission of sound in the low, medium and high range of audio frequency, comprising:

an outer convex cone-shaped part including a suspension rim, an inner dome-shaped part, said convex cone-shaped part being made of paper or polypropylene plastic and said inner dome-shaped part being made of the same relatively thin material utilized in said convex cone-shaped part, said dome-shaped part being relatively stiffer, said inner dome-shaped part having a central hole.

2. The convex diaphragm of claim 1 wherein said outer convex cone-shaped part decreases in angle from said suspension rim toward said inner dome-shaped part, said convex diaphragm being substantially sinus-shaped.

3. A voice coil form, having sufficient stiffness to provide reciprocate motion to a convex diaphragm for overall the audio frequency, comprising:

a cylindrical end having a voice coil wound around thereto and an opposite conical end;

a dome-shaped part adapted to be secured to said convex diaphragm, said conical end partially protruding said dome-shaped part through a central hole in said dome-shaped part, said conical end being secured to said dome-shaped part.

4. The voice coil form of claim 3 wherein said dome-shaped part and said voice coil form are integrated in one single molded element.

5. The voice coil form of claim 3 wherein said conical end is bonded to said dome-shaped part.

6. A full range electrodynamic loudspeaker having hemispherical sound emission characteristics, comprising:

a. a convex diaphragm to provide substantially hemispherical emission of sound in the low, medium and high range of audio frequency having an outer convex cone-shaped part being made of paper or polypropylene plastic and an inner dome-shaped part made of the same relatively thin material utilized in said convex cone-shaped part, said inner dome-shaped part being relatively stiffer, said inner dome-shaped part having a central hole, said convex diaphragm having a suspension rim;

b. a voice coil form to provide reciprocate motion to said convex diaphragm, said voice coil form having a cylindrical end including a voice coil wound around thereto, and an opposite conical end protruding partially said inner dome-shaped part of said convex diaphragm through said central hole, said conical end being bonded to said convex diaphragm by a bonding agent;

c. a permanent magnet assembly means to produce radial magnetic field in an annular space air gap wherein said voice coil is arranged;

d. a resilient spider fastened to said voice coil form, said resilient spider being mounted on said permanent magnet assembly; and e. a frame to support to the above recited elements.

7. The loudspeaker of claim 6 wherein said outer convex cone-shaped part decreases in angle from said suspension rim toward said inner dome-shaped part, said convex diaphragm being substantially sinus shaped.

* * * * *